United States Patent [19]

Vohnout

[11] Patent Number: 4,984,986

[45] Date of Patent: Jan. 15, 1991

[54] APPARATUS AND METHOD FOR TRAINING OARSMEN

[76] Inventor: Vincent J. Vohnout, 3448 Trabue Rd., Columbus, Ohio 43204

[21] Appl. No.: 432,595

[22] Filed: Nov. 7, 1989

[51] Int. Cl.[5] ..... A63B 69/00; G09B 9/06

[52] U.S. Cl. ..... 434/247; 434/392; 272/72; 272/129; 73/379

[58] Field of Search ..... 434/247, 255, 392; 272/72, 129, DIG. 5; 73/379; 128/25 R; 273/148; 114/363; 440/105

[56] References Cited

U.S. PATENT DOCUMENTS

| | | | |
|---|---|---|---|
| 3,266,801 | 8/1966 | Johnson | 272/72 |
| 4,735,410 | 4/1988 | Nobuta | 272/72 |
| 4,875,674 | 10/1989 | Dreissigacker et al. | 272/72 |
| 4,889,509 | 12/1989 | Pohlus | 272/72 X |

FOREIGN PATENT DOCUMENTS

| | | | |
|---|---|---|---|
| 0022085 | 1/1981 | European Pat. Off. | 73/379 |

*Primary Examiner*—Richard J. Apley
*Assistant Examiner*—Joe H. Cheng
*Attorney, Agent, or Firm*—Mueller and Smith

[57] ABSTRACT

A pair boat simulator is provided including a housing which is mounted about a longitudinal roll axis upon supports above a training facility floor. Two racing shell seats are mounted within the housing adjacent simulated oars which are mounted, in turn, upon oarlocks positioned, in turn, upon outrigger assemblies. The simulated oars are foreshortened and include a blade flotation assembly at their tips along with load beam type force transducers. The oars serve to drive a rotatable mass such as a flywheel. Thus, the physical output of each oarsman is commonly coupled to the rotating mass. Instrumentation includes transducers looking to inclinations of the housing about the roll or longitudinal axis, oar elevation and sweep angle as well as blade rotation. These parameters are combined and developed under computer driven control into data presented at visual readouts made available both to the oarsman and coach. Such readouts include, for example, force versus sweep angle graphs, animated displays of heading, lateral position and hull velocity; values of effective power and rowing efficiency.

28 Claims, 9 Drawing Sheets

10
12
14
16
18
20
22
24
26
28
30
32
34
36
38
42
44
64
66
80
82
86
88
90
92
94
96
98
100
108
109
110
112
114
116
120
122
123
124
126
128
130
132
134
136
138
142
144
146
147
148
150
154
160
162
164
166
170
184
186
188
190
196
200
208
210
222
234
236
250
252
254
256
260
264
268
290
292
294
3
5
6
132'
134'
136'
138'
142'
144'
146'
147'
148'
150'
160'
162'
164'
166'
170
184'
260'
264'

APPARATUS AND METHOD FOR TRAINING OARSMEN

BACKGROUND OF THE INVENTION

Training systems for the sport of organized rowing have been the subject of investigation since the 19th Century. Using light, elongate boats or "shells", designed for carrying a single, a pair, four, or eight oarsmen, two basic oar configurations are employed. In one asymetric configuration referred to as "sweeping", each oarsman mans a single oar dedicated to one side, port or starboard of the boat. In another configuration, referred to as "sculling" each oarsman mans two oars which are symmetrically paired and extend from each side of the boat. The sport imposes not only significant physical demands upon the oarsman-athlete, but also requires important and somewhat subtle technique. Because of this latter factor, a physically strongest oarsman may not be a coach's best selection as a crewman for a boat.

Rowing technique involves many aspects. The oar must properly "catch" or enter the water, following which a "rotation" about the oarlock pin with applied force occurs. During this boat accelerating maneuver, the "elevation" of the oar, i.e. the angle between the boat plane and the oar axis is critical. Finally, the "roll-up" or angle of rotation of the shaft of the oar at the oarlock is important. Without proper roll-up, timing and angulation, a proper catch maneuver becomes more difficult. The seats within the boat hulls within which oarsmen sit are mounted such that they slide along the longitudinal axis of the hull. Thus, in the course of executing a stroke, the oarsman slides forward on the seat towards a footrest or "foot stretcher" bending the knees to achieve a posture for developing a maximized force while drawing an oar through a sweep angle. As the latter stroke ensues, the position of the seat and thus the oarsman is important to maximizing generated thrust. Where the seat is moved during the stroke too rapidly, the orientation of the oarsman's torso will become inefficient for force development.

While carrying out this stroking maneuver, the oarsman must maintain the "set" of the boat such that its transverse plane or boat plane is parallel to the water's surface. Rolling the hull of the boat to a starboard or port side in the course of extending an oar to a catch position is commonly encountered with novice oarsmen. For example, to achieve a proper catch it is necessary that the oarsmen reach essentially beyond the gunwales of the boat with the oar handle. The resultant anatomical position is one which, without appropriate training, is one which will tend to induce a roll about the boat's longitudinal or roll axis. Where the set of the boat is incorrect, the oarsman catching at the downward side of the boat will tend to position his oar blade too deeply, while the oarsman on the opposite side of the boat will position the oar blade too shallow or "washout". Failure to carry out proper technique results in a variety of consequences ranging from loss of speed to such a condition as is typically referred to as "catching a crab". In the latter regard, where the blade setting at the catch is improper, the blade "goes deep" and all control is lost as the inertia of the boat itself drives the oar. The high level dynamic forces associated with this condition have been observed to launch an oarsman from a boat even though his feet were tightly held in foot stretchers.

Proper technique becomes critical in the manning, for example, of a boat requiring eight oarsmen. These "eights" are mainline boats in organized racing, being the fastest of those used. Typically, racing courses are arranged along lanes defined by marker buoys, the boats being rowed centrally within each of these lanes. Where the crews are not fully trained or, in effect, unmatched, a variety of conditions may ensue during a race which generates conditions, the end of which is loss of speed. For example, should more force be developed by the oarsmen on one side of the boat than the other in a race of sweep configured boats, then the boats will tend to turn and move from proper position within a given lane. Thus, it is important that the training technique develop a coordination amoung the rowers of a given boat, a situation again representing "technique".

Often team training, intended for manning of an eight is developed in by training in "pair" boats. Such two-man craft are more dynamically sensitive, requiring closer coordination and interaction between the two oarsmen manning them. Accordingly, oarsmen may be paired in these smaller craft and four, pair trained crews then are combined to man an eight. Generally, the coordination and interaction or technique of a well-trained eight crew is such that any one oarsman is attuned to the other seven oarsmen in the boat.

Oarsmen-athlete training devices heretofore developed, while in some cases being quite elaborate, have exhibited relatively minor capability for training the technique rowing, and in many instances have no value in the training of technique. Some of the devices are structured as physical exercise machines intended to improve only the factor of physical strength. Popular among these implements are those fashioned as ergometers wherein the strength of the oarsman can be quantified. However, the mere quantification of athletic strength is found not be a sufficiently valid measure, for example, for a coach to achieve an optimized crew selection for an "eight". Generally, the hydrodynamics of boat propulsion involve the inertia of the boat and the viscous drag of the water surrounding it. Typical simulators have employed flywheels driven by the oars of the simulator to emulate the inertial or mass term, while a variety of approaches have been advanced to emulate the viscous drag term. The latter approaches have ranged from basic coulombic braking to the magnetic generation of electrical eddy currents within flywheels otherwise deriving the mass term. More elaborate training installations have been developed to improve the emulation of the "feel" of rowing by resort to elongate troughs through which a large quantity of water is pumped. Crews sit adjacent such troughs upon stationary supports and trolly mounted seats with oars extending from oar locks into the water filled troughs. While coaches are permitted close observation of the oarsman-athlete with such facilities, a refined training in technique is not achieved, inasmuch as there can be no awareness or dynamic communication between athletes through the medium of the boat structure. Additionally, the flotational dynamics of a boat are not emulated.

For both the purpose of aiding the athlete in perfecting each of the various techniques required of the sport, as well as for aiding coaches and their staffs in developing optimized team selection procedures, a procedure and apparatus implementing a quantification of the aspects of technique will represent an important contribution to the sport of competitive rowing.

SUMMARY

The present invention is addressed to apparatus and method for training oarsmen which serves to facilitate the development of good rowing technique. In addition to providing the physical conditioning capabilities of conventional ergometers, the apparatus represents a kinematically accurate mechanism and associated computer simulation of a racing shell on water. Thus, a more realistic rowing experience becomes available with desired accompanying feedback both to the coach and to the oarsman in training. With the instrumentation and associated feedback, the technique of the oarsman may be quantified and displayed at visual readouts available to the oarsman and coach in the course of training procedures. In this regard, the oarsman may observe an animated display showing heading, lateral position between buoys defining a lane as well as forward velocity. Graphical displays presented to the oarsman and coach include graphs of force versus sweep angle of the oars; seat position versus the sweep angle of the oars; oar elevation versus sweep angle of the oars; and rower output power or effective stroke power versus stroke number. Of particular help in evaluating athlete oarsmen, the effective stroke power of each oarsman in a pair simulator is generated, this parameter representing the relationship of Stroke Effective Work to Stroke Period. Additionally, the efficiency of the athlete in carrying out a rowing procedure is computed and quantified as a rower effectiveness factor corresponding with the relationship of the Stroke Effective Work computation and the Stroke Rower Work computations developed from instrumentation of the system. Other outputs displayed to the oarsman in the course of training include stroke rate, boat velocity for 500 meter time; elapsed distance or distance to go; elapsed time of a piece; projected finish time; the oar blade state for each rower and the heart rate of each rower.

Another feature of the invention provides apparatus for training oarsmen to row a racing shell operationally exhibiting given mass and hydrodynamic drag terms which includes a racing shell simulative housing having a longitudinal roll axis and a given boat plane. An oarsman seat is mounted in the housing and an oarlock is supported from the housing. A simulated oar extending along an oar axis is pivotally mounted with the oarlock and a rotatable mass is mounted for rotation with respect to the housing for simulating the mass term. A drive linkage is coupled in driven relationship with the simulated oar and in driving relationship with the rotatable mass and a drag or modulating arrangement is provided for imposing select drag upon the rotatable mass which, for example, is simulative of a hydrodynamic drag term. A sweep angle transducer responds to the sweep angle of the oar for providing a sweep angle output and a force transducer responds to the forces transmitted by an oarsman through the oar while positioned upon the seat for providing a force output. A control arrangement responds to the sweep angle output and to the force output for deriving a power stroke output representing values of force exerted from the oar with respect to sweep angle and a readout responds to this power stroke output for providing a perceptible readout representative thereof.

Another feature of the invention provides apparatus for training oarsmen to row a racing shell operationally exhibiting given mass and hydrodynamic drag terms which includes a racing shell simulative housing having a longitudinal axis and a given boat plane. First and second spaced oarsmen seats are mounted upon the housing and first and second oarlocks are supported from the housing adjacent the respective first and second seats. First and second simulated oars, each extending along an oar axis and pivotally mounted with respect to first and second oarlocks are provided and a rotatable mass is mounted for rotation with respect to the housing for simulating the mass term. First and second drive linkages are connected in driven relationship with respect to first and second oars and with the rotatable mass and a drag arrangement is provided for imposing a select drag upon the rotatable mass which is simulative, for example of the hydrodynamic drag term.

Another feature of the invention provides a method for evaluating the performance capability of an oarsman for rowing racing shells exhibiting given mass and hydrodynamic drag terms which comprises the steps of:

providing a racing shell simulative housing having a longitudinal axis and a given boat plane;

providing an oarlock supported from the housing;

providing a simulated oar extending along an oar axis and pivotally mounted with the oarlock;

providing an oarsman seat mounted upon the housing;

providing a rotatable mass mounted for rotation with respect to the housing for simulating the mass term;

providing a drive linkage coupled in driven relationship with the oar and in driving relationship with the rotatable mass;

providing a drag assembly for selectively controlling the rotation of the rotatable mass;

providing a sweep angle transducer responsive to the sweep angle of the oar for providing a sweep angle output;

providing a force transducer responsive to the forces transmitted by a said oarsman through said oar into the drive linkage and rotating mass while positioned upon the seat for providing a force output;

causing an oarsman to sit upon the seat and execute an oarstroke with the oar;

providing a computer driven control responsive to the sweep angle output and the force output derived from the oarstroke;

generating with the control a power stroke output representing the value force exerted during the oarstroke with respect to sweep angle; and displaying power stroke output to the oarsman in visula graphic form.

Another feature of the invention is the provision of apparatus for training oarsmen to row a racing shell operationally exhibiting given mass and hydrodynamic drag terms which includes a racing shell simulative housing having a longitudinal roll axis and a given boat plane. An oarsman seat is mounted upon the housing and an oarlock is supported from the housing. A simulated oar extends along an oar axis and is pivotally mounted with the oarlock and a rotatable mass is mounted for rotation with respect to t the housing for simulating the mass term. A drive linkage is coupled in driven relationship with the oar and in driving relationship with the rotatable mass and a drag arrangement is provided for imposing a select drag upon the rotatable mass simulative of the hydrodynamic drag term. Oar blade simulation is provided by a blade flotation simulator which is responsive to movement of the oar and simulates the flotation of the oar blade in water.

Other objects of the invention will, in part, be obvious and will, in part, appear hereinafter.

The invention, accordingly, comprises the apparatus and method possessing the construction, combination of elements, steps and arrangement of parts which are exemplified in the following detailed disclosure.

For a fuller understanding of the nature and objects of the invention, reference should be had to the following detailed description taken in conjuction with the accompanying drawings.

DETAILED DESCRIPTION OF THE INVENTION

Figure 1:
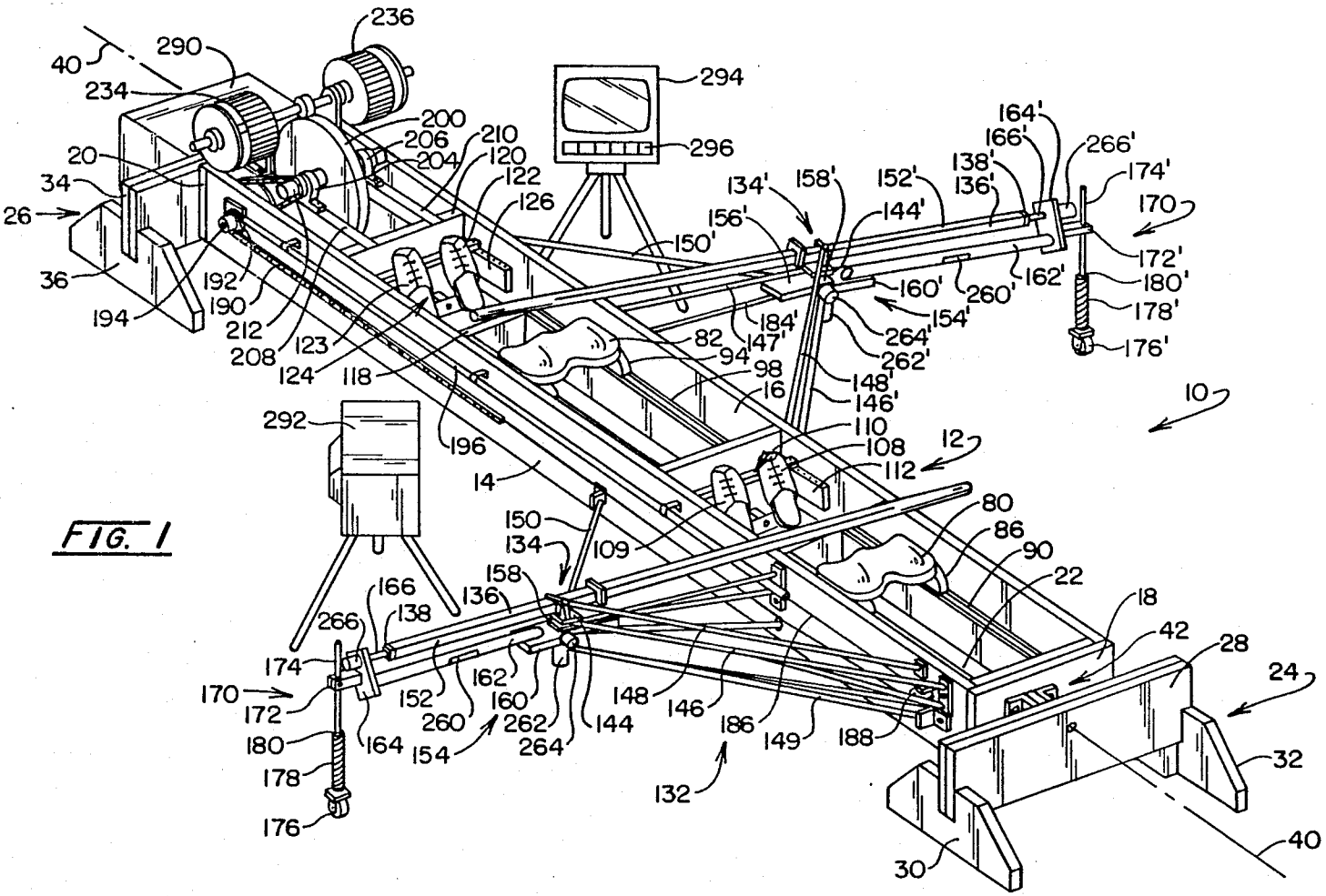
FIG. 1 is a perspective view of apparatus according to the invention.

Referring to FIG. 1, training apparatus according to the invention is represented generally at 10. This apparatus 10 functions to simulate certain critical aspects of the kinematics of rowing and to combine this simulation with a performance quantification and biofeedback which may be used both by the oarsman in training as well as coaches to improve and evaluate both overall performance and performance specific to isolated aspects of technique. The apparatus functions to model certain aspects of the rowing function in a mechanical analog fashion, as well as to carry out microprocessor driven simulation and evaluation to achieve the noted quantification. The device is structured so as to be fabricable at reasonable cost and is of size permitting its use in conventional indoor training facilities.

In FIG. 1, the apparatus 10 is seen to include an elongate rectangular housing represented generally at 12. Housing 12 may be conveniently formed of wood and includes two elongate side members 14 and 16 which are joined together by wooden end structures 18 and 20. A floorboard as at 22 may be provided with the housing 12.

Figure 2:
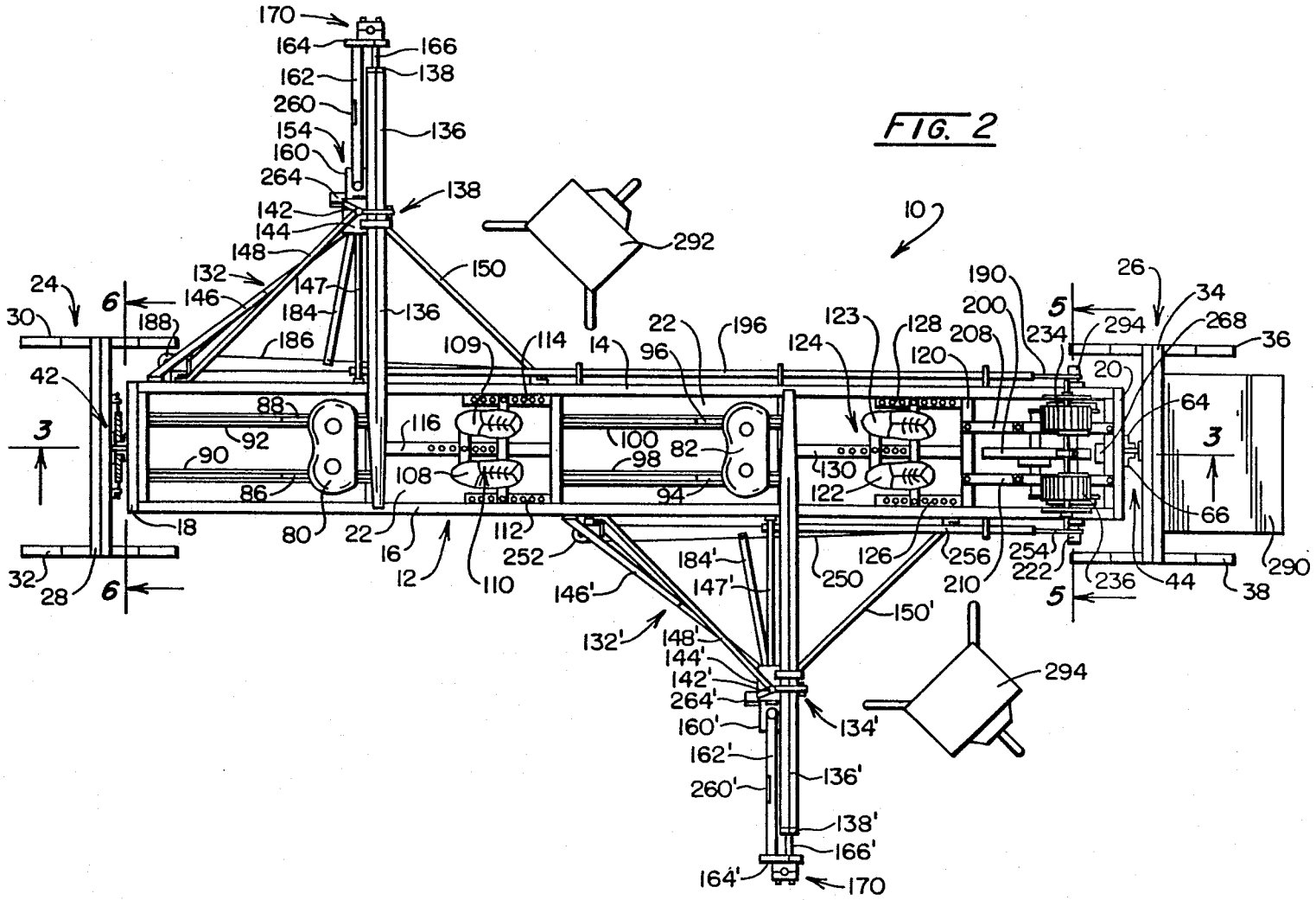
FIG. 2 is a top view of the apparatus of FIG. 1.
Figure 3:
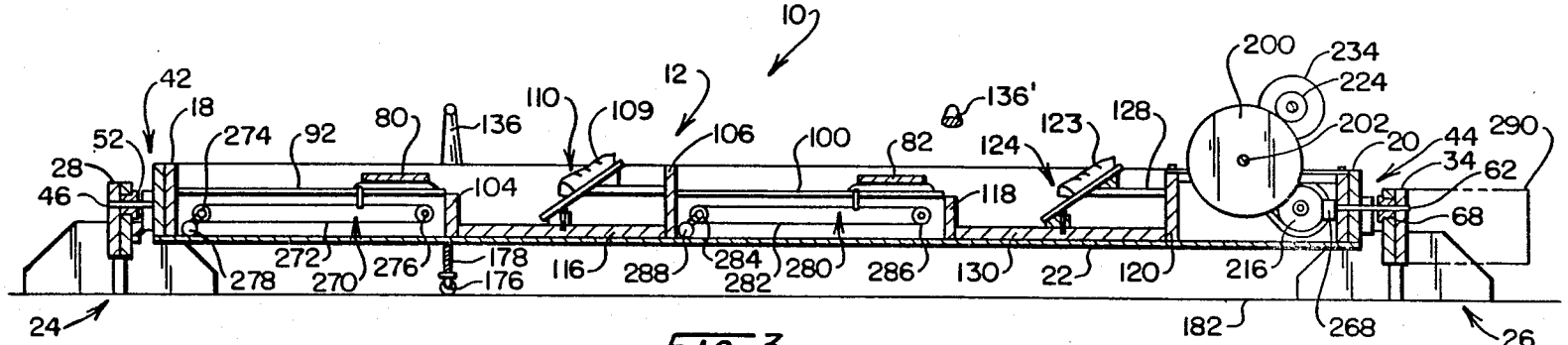
FIG. 3 is a sectional view taken through the plane 3—3 shown in FIG. 2.
Figure 6:
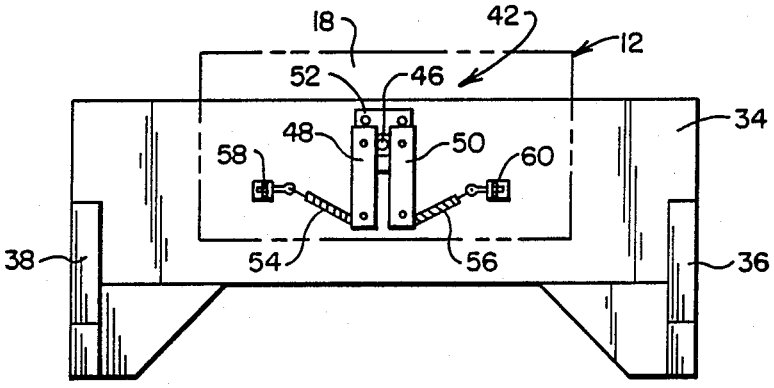
FIG. 6 is a sectional view taken through the plane 6—6 shown in FIG. 2.

Housing 12 is supported above the surface of a floor by a floor engaging support structure including support components 24 and 26 positioned at the lengthwise extremities of the housing 12. Looking additionally to FIG. 2, component 24 is seen to include a crossbeam 28 which is supported from and elevated above the floor surface by two transversely oriented foot components 30 and 32. In similar fashion, support component 26 includes a crossbeam 34 supported by foot components 36 and 38. The housing 12 is pivotally coupled to support components 24 and 26 along a roll or longitudinal axis in a manner serving to simulate the roll characteristic of the hull of a racing shell. Referring additionally to FIGS. 3 and 6, the pivot assemblies providing for this roll simulation are represented in general at 42 and 44. Each of these assemblies is seen to incorporate an outwardly projecting pivot rod or cylindrical axle which extends into a corresponding support component mounted bearing. In this regard, looking to FIG. 6, the pivotal assembly 42 is seen to include an axle 46 extending normally outwardly from end assembly 18 by welded connection to the outwardly extending flanges of two angle irons 48 and 50. These angle irons 48 and 50, in turn, are bolted to end assembly 18 of the housing 12. Axle 46 pivotally supports the housing 12 by virtue of its insertion into a bearing 52 mounted in recessed fashion within crossbeam 28. Bearing 52 preferably is of a "floating" type which provides for effective pivotal mounting notwithstanding any non-perpendicular relationship between axle 46 and the bearing. Such an arrangement accommodates for the typically encountered variations from level of floors within training facilities. To simulate the "feel" of any induced roll of a hull in water, two preloaded helical springs also are incorporated within the assembly 42. FIG. 6 shows counterloaded springs 54 and 56 having one end coupled via adjustable turnbuckles to end structure 18 as represented respectively at 58 and 60. The opposite ends of springs 54 and 56 respectively are coupled to angle irons 48 and 50. Thus, any physical activity of an oarsman in training utilizing the apparatus 10 which would otherwise cause a roll effect will be kinematically simulated with the instant apparatus. Looking to FIG. 3, pivot assembly 44 at the opposite end of the apparatus 10 is seen to include a pivot rod or axle 62 which extends from its mounting upon end structure 20 with angle irons 64 and 66 (FIG. 2) into a bearing 68 recessed within crossbeam 34. Bearing 68 may be provided having the floating feature described above in conjunction with corresponding bearing 52.

The simulated roll characteristic provided by the pivotal mounting of housing 12 contributes to the improvement and measurement of technique developed in pair boat rowing. Two seat positions are located within housing 12 and the spacing of side supports 14 and 16 is such as to simulate the corresponding spacing of a rowing shell. Looking to FIGS. 1 and 2, two seat positions are seen to be located within the housing 12. A simulated bow seat is shown at 80, while a corresponding simulated stroke seat is shown at 82. Preferably, these seats are identical to those used in a racing shell and thus, the seats will slide along the longitudinal axis 40 of the housing 12. To facilitate this sliding movement, the seats are positioned upon carriages having wheels which freely rotate within stringer mounted tracks positioned, in turn, within the housing 12. In this regard, note that the seat 80 is includes integrally formed wheel carriage components 86 and 88 (FIG. 2), the latter components, in turn, riding within respective stringer mounted tracks 90 and 92. Similarly, seat 82 is seen in FIG. 2 to be carried by wheel carriage components 94 and 96 which respectively ride within tracks 98 and 100.

Each of the seat positions also is associated with a foot support in a manner essentially geometrically identical with those provided in a pair boat. In this regard, FIG. 3 reveals that the foot support retaining area of the housing 12 is buttressed for simulator entry by a floor support board 102 extending between a partition 104 and a bulkhead 106. Each of these seat region supports 104 and 106 extends between the side components 14 and 16 of housing 12. The foot positions are comprised of two conventional foot stretchers seen in FIG. 2, for example at 108 and 109, which preferably are identical to those used within racing shells. These devices 108 and 109 have rigid "soles" and are secured to the athlete's foot by a shoestring form of attachment. Each of the foot stretchers 108 and 109, in turn, is coupled to a frame structure 110 which is adjustably mounted with thumbscrews to upwardly disposed receiving plate structures 112 and 114 coupled, respectively, to side members 14 and 16 and a lower disposed receiving plate structure 116. Structures 112, 114, and 116 may be formed as lengths of rectangularly shaped wood, the topmost portions of which are employed to support a metal plate having a sequence of threaded bores therein. Thus, through the utilization of adjustable thumbscrews or the like, the position of the foot stretchers 108 and 109 may be adjusted by the oarsman.

In similar fashion, the foot positioning region of housing 12 associated with stroke seat 82 includes a partition 118 and bulkhead 120 (FIG. 3). Between these components, two foot stretchers 122 and 123 may be positioned (FIG. 2) which, in turn, are diagonally supported upon a frame structure 124. Frame structure 124, in turn, is adjustably positioned and secured, for example, by thumbscrews upon upwardly disposed receiving plate structures 126 and 128, as well as upon lower disposed receiving plate structure 130. Structures 126, 128, and 130 each include an upwardly disposed steel plate carrying sequences of threaded bores to provide for the adjustment of frame 124 and foot stretchers 122 and 123 with respect both to angular orientation and longitudinal position with respect to seat 82.

The oar and oarlock assemblages associated with bow seat 80 and stroke seat 82 of the simulator apparatus 10 accurately follows the corresponding structure actually used with racing hulls. In this regard, the sweep architecture associated with seat 80 is seen to include an outrigger structure represented generally at 32 which includes several rod-like components. These rod-like components are fixed to member 14 and extend in angular fashion to provide a stable support for a conventional, D-shaped oarlock structure represented generally at 134. Within the oarlock structure 134 there is positioned a simulated oar 136 which, in the interest of accurate simulation may be provided as an actual sweep oar having the outwardly disposed blade components removed to provide an outer, foreshortened tip 138.

Figure 4:
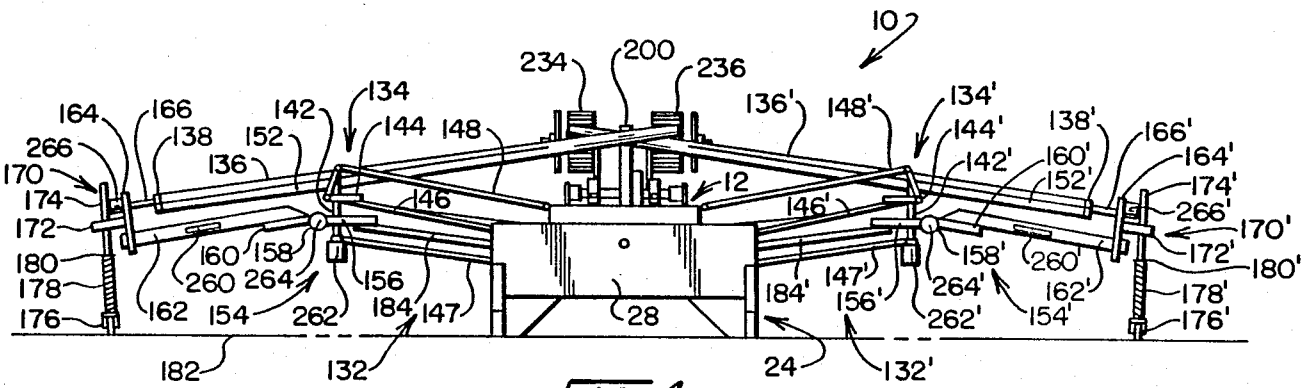
FIG. 4 is a front view of the apparatus of FIG. 1.

Looking to FIGS. 2 and 4, the principal thrust resisting component of the oarlock assembly 134 is a rigid steel pin or rod 142 which is fixed to and extends through a support plate 144. Support plate 144 is, in turn, supported at its underside by rods 146 and 147 of the outrigger structure 132. The upwardly disposed portion of pin 142 is supported by rod 148 of outrigger structure 132 while the opposite or lower disposed end thereof is supported by connection with rods 149 and 150 of structure 132 (see additionally FIG. 1). It may be noted that in furtherance of the accurate simulation of an actual sweep oar, oar 136 is configured having a flat thrust or force transfer surface 152 which compressively engages the pin 142 in the course of a force producing sweep. This traditional oar structuring aids the oarsman in developing proper blade alignment or angle in the course of a powering stroke.

Pivotally mounted upon the steel pin 142 beneath support plate 144 is a hinged force transfer assembly 154. Looking to FIG. 4, the assembly 154 includes a rotatable plate 156 pivotally mounted upon pin 142 which is connected by a heavy-duty clevis pin type hinge 158 to a connector plate 160. To connector plate 160 there is coupled one end of a load arm or load tube 162 the opposite end of which is rigidly fixed to a tip plate 164 which, as revealed in FIG. 1, is canted in the direction of the force producing sweep of oar 136. Tip plate 164 is configured having an aperture therein (not shown) which slideably receives a cylindrical pin 166 fixed to and extending along the axis of oar 136 from its tip 138. Thus, the oar 136 may be freely rotated by the oarsman while the movement thereof is translated from tip 138 and pin 166 to tip plate 164. Tip plate 164, in turn, transfers sweep and elevational angle motion into the load tube 162. Tube 162, in turn, transmits this same motion and associated force into the force transfer assembly 154.

Coupled to tip plate 164 is a blade flotation simulator generally at 170. As seen in FIG. 4, th flotation simulator 170 includes a mounting bracket 172 which is coupled to tip plate 164 and extends outwardly therefrom. To the bracket 172 there is coupled a tube 174 within which a steel rod (not seen) slideably extends and the lowermost tip of which is coupled within a correspondingly freely rotating caster wheel assemblage 176. A resiliently deformable or compressible helical spring 178 extends between the uppermost flange of wheel assembly 176 and an abutting washer 180 is positioned against the lowermost tip of tube 174. Flotation simulator 170 is adjusted such that the wheel of caster wheel assembly 176 makes contact with the floor or contact surface respresented at 182 of the facility within which apparatus 10 is installed at a point in time when the imaginary blade extending from oar simulator 136 would contact the surface of th the water in which a boat being simulated would be floating. This position can be respresented or monitored by the elevation angle of simulated oar 136. The resiliency of spring 178 is selected such as to simulate the upwardly directed buoyancy force imposed upon a conventional oar blade. It further may be noted that should the oarsman cause the simulator housing 12 to tilt about its pivotal mounting the blade flotation simulation will come into effect at an oar elevation angle of lesser extent than normal to achieve a modeling or simulation of the error of such a rowing condition.

A partial modeling of the mass term and hydrodynamic drag term attributes of a racing shell are simulated by the resistive forces experienced by the oarsman through the oar 36. The linkage into this modeling approach is from oar tip 138 and pin 166 to the tip plate 164 and load tube 162 to the force transfer assembly 154. As seen in FIG. 4, rotatable plate 156 of force transfer assembly 154 is weldably coupled to a force transfer arm 184 extending toward side member 14 of housing 12. Looking to FIG. 2, the end of arm 184 is coupled to the lower disposed portion of a wire cable 186. As seen in FIG. 2, cable 186 is wound about a freely rotatable pulley 188 and, as additionally seen in FIG. 1, the lower loop of cable 186 is seeen to extend to a connection with a drive chain 190, which, in turn, is would about a sprocket 182 which is mounted upon an axle or shaft 194 (see FIG. 5). Drive chain 190 continues about sprocket 192 and extends through a protective tube 196 supported by brackets from side member 14. The chain 190 then is coupled to the opposite, upwardly disposed end of cable 186.

Figure 5:
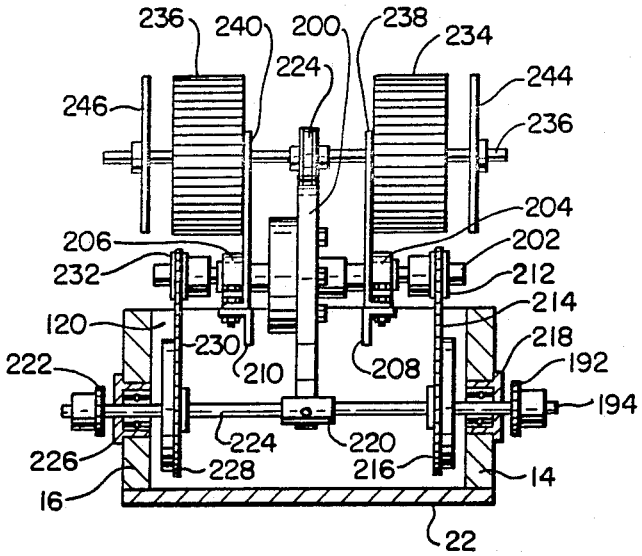
FIG. 5 is a partial sectional view taken through the plane 5—5 shown in FIG. 2.

The assemblage thus far described including the simulated oar 136, load arm or tube 162, force transfer arm 184, and the cabling assemblage including cable 186 and drive chain 190 functions to impart energy from the oarsman to a rotatable mass which functions, in turn, to simulate the mass term respresented by a boat and the oarsman therein. Referring to FIG. 5, this rotating mass is implemented as a flywheel 200 mounted for driven rotation upon a shaft or axle 202. Axle 202, in turn, is rotatably supported by oppositely disposed pillow block bearing 204 and 206 which, in turn, are supported from respective lengths of angle iron or, where required aluminum angle 208 and 210. The latter support components extend between and are supported from bulkhead 120 (FIG. 3) and end structure 20. Axle 202 and, thus flywheel 200 is driven at the starboard side of the structure by a one-way clutch 212 fiaxed thereto and having a sprocket inptu coupled with a drive chain 214. Drive chain 214, in turn, is driven from a sprocket or pulley 216 which is fixed to shaft 194. Shaft 194, is supported by a bearing 218 recessed within side member 14 and extending to the freely pivoting connection with a connector bearing 220. In general, a primary driver is respresented by the starboard oar 136 of the simulated boat and the cable-chain input is associated with the final drive respresented by sprocket 216 and the associated drive input to one-way clutch 212 to provide about a 40:1 1 overdrive ratio.

Both the bow and stroke oarsman positions are mass coupled within the instant system by virtue of their driving connection with flywheel 200. In this regard, FIG. 5 reveals that the drive input to the flywheel 200 is symmetrical, a drive sprocket 222 being mounted upon shaft or axle 224 which extends, in turn, between a bearing 226 recessed within side member 16 and extending to the opposite side of connector bearing 220. The sprocket 228 is seen coupled in driving relationship by a chain 230 to a one-way clutch 232 coupled to shaft 202. Thus, the efforts of each of the oarsmen under training with apparatus 10 are coupled to the same rotating mass represented by flywheel 200.

The viscous drag term of the boat simulation can be implemented with a variety of approaches. One such approach is represented in the figures heretofore discussed as being provided by a squirrel cage fan arrangement. In this regard, two such fans as at 234 and 236 are provided which are mounted in spaced relationship and in common upon a fan shaft 236 which, in turn, is mounted upon spaced brackets 238 and 240. Brackets 238 and 240 are bolted to earlier-described angle iron or aluminum angle components 208 and 210. Drive is imparted to shaft 236 from the surface of flywheel 200 by contact of the outer surface thereof with a rubber surfaced drive wheel 224 fixed to shaft 237. Thus, a drag term which is imposed as an exponent of flywheel speed is developed by the arrangement shown. The amount of this hydrodynamic drag simulation can be adjusted by carrying out a mechanical adjustment of the extent of the air input opening for fans 234 and 236. This adjustment to the fans 234 and 236 is provided by an adjustment of the positions of input port disks 244 and 246 upon axle 236.

Returning to FIGS. 1, 2, and 4, the stroke oarsman's position represented at seat 82 providing for performance at the port side of the simulator is seen to be configured in substantially identical fashion as the bow stroke position described in conjunction with seat 80. Thus, where components are identical, the same numeration as applied with the bow stroke seat 80 position are applied in conjunction with this stroke seat position but in primed fashion. Thus, an outrigger structure is represented generally at 132' as functioning to support a D-shaped oarlock structure represented at 134'. A simulated oar is provided at 136' having a tip 138'. FIG. 4 shows a rigid steel pin 142' fixed to and extending upwardly from a support plate 144' which is retained in position, in turn, by rod components of the outrigger assembly 132'. This assembly 132', as before, is seen to be comprised of rods 146'–150' extending, as earlier described, to the support plate 144' and pin 142'. Oar 136' is seen to have a flat force transfer surface 152' which engages the pin 142' in pivoting fashion. A force transfer assembly is provided as shown generally at 154' in FIG. 4. This assembly includes a rotatable plate 156' which is mounted for pivotal movement about the pin 142'. The plate 156' also incorporates a heavy-duty, i.e. clovis pin type hinge 158' which, in turn, supports a connector plate 160' (FIG. 4). Rigidly coupled to connector plate 160' is a load arm or load tube 162' which extends at its outer end to a rigid connection with a tip plate 146'. A pin 166' extends from the tip 138' of oar 136' to pivotally engage the tip plate 164' and impart sweeping force derived motion thereto.

The tip plate 164' is canted in the direction of forceable thrust of oar 136' and includes a blade flotation simulator 170' which is secured to plate 164' by a mounting bracket 172' which functions to support an upstanding tube 174'. The caster wheel assembly 176' is supported upon a rod (not seen) slideably positioned within tube 174' and is resiliently active by virtue of a helical spring 178' retained between the caster assembly 176' and a washer 180' positioned against the bottom side of tube 174'. As before, the caster assembly 176' makes select contact with a contact surface or floor 182 (FIG. 4) depending upon the elevation angle of simulated oar 136'.

Looking to FIG. 2, a force transfer arm 84' is seen rigidly coupled to rotatable plate 156' and extending to a connection with a looped cable 250. Cable 250 extends about a pulley 252 fixed to and extending outwardly from side member 16. The cable 250 is seen to extend to a drive chain which, in turn, is wound in driving relationship about sprocket 222 as described earlier in conjunction with FIG. 5. The chain 254 then extends through a polymeric protective tube 256 supported from side member 16 by brackets. Thus, the oarsman in training may drive the flywheel 200 from oar 136' in the same manner as an oarsman couples energy from oar 136. Because of the earlier discussed one-way clutch arrangement at 232 (FIG. 5) both oarsmen will contribute to the energy input to flywheel 200 in pair boat simulation.

As before, the primary and final drive arrangement extending from oar 136' develops an overdrive at a ratio of, for example 40:1. The corresponding ratio for both oarsmen as considered with respect to the fans 234 and 236 may, for example, be about 130:1. These ratios may be varied depending upon the mass term associated with given oarsmen and boat configurations. For instance, the mass term will alter where the oarsman may be of light or heavier weight from an initial given calibration.

While a sweep form of architecture is shown as represented by oars 136 and 136', it should be apparent that the apparatus 10 may be configured having a scull configuration wherein oar structures are positioned on either side of each seat position and mass coupled to the flywheel 200.

In order to apprise the oarsman utilizing the simulator apparatus 10 as well as their coach as to the relative effectiveness of their effort, important aspects of their performance are monitored by sensing devices the information from which is quantified to develop data which then can be treated under computer control to achieve an evaluation. This evaluation also is manifested in the feel returned to the oarsman by simulator control of such aspects as the hydrodynamic drag term at the flywheel 200. Such evaluations may, for example, be used in crew selections for races in various forms of boats. An initial one of the parameters to be evaluated is associated with the aspect of the amount of force the oarsman applies from an oar as at 136. A prime measurement for this force is generated from the load arms or load tube components 162 and 162'. These load devices are configured as load beams and, thus, each is structured having two strain gauge assemblies affixed thereto. The strain gauges for one position shown in FIGS. 1 and 4 at 260 and 260'. Additionally, strain gauge assemblies (not shown) are mounted on the opposite sides of these load tubes or load arms 162 and 162'. The strain gauges incorporate conventional bridge and amplification circuitry which, conveniently, may be packaged within the tubular configuration of the load components 162 and 162'. This packaging arrangement facilitates and simplifies field repairs of the apparatus. Instantaneous force values which may be read out from such transducers as at 260 and 260' which, for example, may be evaluated with respect to corresponding instantaneous values of sweep angle for the simulated oars 136 and 136'. To derive this instantaneous sweep angle information, potentiometers as shown at 262 and 262' are affixed to the outrigger assemblies as represented in FIG. 4 to provide a readout of the rotation, for example, of supporting plates 144 and 144'. Positioning and selection of these potentiometers generally is at the convenience of the designer, however, film-type potentiometers as, for example, single turn precision devices, type 6538 marketed by Bourns, Inc. of Riverdale, Calif. are available for application with apparatus 10. The elevation angle of simulated oars 136 and 136' with respect to the boat plane which may, for example, be considered as extending across the top edges of side members 14 and 16, is measured at the hinge region 158 and 158' of respective force transfer assemblies 154 and 154'. Potentiometers employed for this use are shown, respectively, at 264 and 264' as seen in FIGS. 1, 2, and 4. Instantaneous information as to this elevation angle may be employed in evaluating and quantifying the effectiveness of the stroke of the oarsman as it is concerned with simulated depth of an oar blade within water or its position in air above water and as modified, for example, by the roll of the housing 12 about longitudinal axis 40.

The rotational orientation of simulated oars 136 and 136' throughout all portions of a stroke on the part of the oarsman also represents an important facet of performance and technique evaluation. In this regard, the blade is "feathered" as it is maneuvered from a lift to a catch position and its orientation during such movement should be parallel to the plane of the surface of the water. Similarly, the blade of the oar should be perpendicular to the water surface from the catch position through the stroke. Where this perpendicularity is not present, then the effectiveness of the stroke is diminished and crab or washout conditions may be encountered. With the instant system, a potentiometer form of transducer is used to provide a rotation output which, in turn, is utilized to develop a factor employed in overall stroke evaluation. The potentiometers developing this output are shown at 266 and 266' mounted upon respective tip plates 164 and 164' and rotatably driven from respective oar pins 166 and 166'. The angular orientation of the oar about its longitudinal axis for the "roll up angle" is important. For example, if roll-up at the termination of a stroke is not carried out with proper timing, the oarsman will experience difficulty in achieving a proper catch or point of stroke where the oar enters the water.

Looking to FIG. 3, a transducer 268 is seen mounted to the inwardly-disposed surface of end structure 20. This transducer preferably is provided as a damped pendulum variety of potentiometer. These devices are constructed having a very low bearing friction and are encased in a viscous fluid so as to damp out high frequency oscillation to improve the quality of the output signal therefrom. The devices are selected for the instant use as opposed to conventional potentiometers inasmuch as the support assembly for the housing 12 may not be located on a level floor. The pendulum arrangement provides simulation of a boat wherein the plane of the boat as earlier described is always perpendicular to the force of gravity when floating without extraneous forces in the water. Preferably, the transducer 268 is located at the longitudinal roll axis selected for the housing 12. This is the axis representing that about which a hull will roll when floating in water. Transducer 268 may be provided, for example, as a Model CP17-0601-2, marketed by Humphrey, Inc. of San Diego, Calif. The instant function also can be provided with a fluid potentiometer type of inclinometer.

FIG. 3 also reveals a transducer form of monitoring of the position of seats 80 and 82 with respect to the longitudinal or roll axis of the boat or housing 12. The proper location of seat position both in the course of the stroke and the velocity or relative position during a return in the course of developing a catch position are important both to the oarsman and to the coach. For example, if the oarsman runs the sliding seat forwardly too rapidly and then abruptly stops it whereupon the oar is positioned for a catch, a condition described by oarsmen as "checking the boat down" may be encountered resulting in an inefficient transmission of energy from the oarsman to the function of propelling the boat. To monitor instantaneous seat position, seat 80 is shown coupled to a cable loop drive represented generally at 270 and including a loop configured cable 272 extending between two pulleys 274 and 276, the upper loop component of which is coupled to seat 80. Pulley 274 is coupled in rotatably driving relationship with a potentiometer form of seat position transducer 278. Thus, the seat position output may be generated which is factored into an evaluation of the overall effectiveness of the oarsman stroke. In similar fashion, a cable loop drive is operationally associated with seat 82 as represented generally at 280. This drive 280 includes a cable 282 connected as a loop and extending over pulleys 284 and 286. As before, the cable 282 is connected to slideable seat 82 and pulley 284 is coupled in driving rotational association with a seat position transducer 288 serving to derive an instantaneous seat position output for employment by the control function of apparatus 10. With respect to the latter control function, for convenience, it may be mounted within an enclosure affixed to end structure 20 as represented at 290 in FIGS. 1 and 3.

Other approaches may be employed for tracking seat position. For example, a single turn twist may be formed in an elongate bar of rectangular cross section and may be rotationally driven from the seat to, in turn, rotate the input to a potentiometer.

Finally, a tachometer 248 is shown in FIG. 2 to be driven from flywheel 200 to provide a signal representing the rotational speed thereof.

FIG. 1 additionally shows a CRT form of readout positioned for visual observation by each of the rowers within seats 80 and 82 as represented, respectively, at 292 and 294. Each of these readouts 292 and 294 include push-button forms of input as represented by the array thereof at 296 positioned at the face of readout 294. These buttons may be employed to select modes of operation for the computer driven control circuitry. Preferably six, SPST momentary contact switches are provided for this function.

Figure 7:
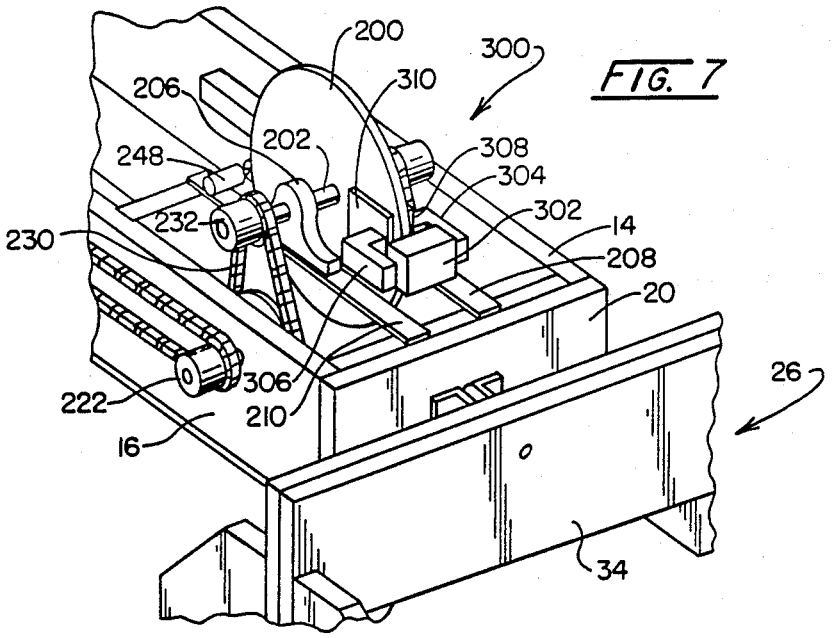
FIG. 7 is a partial perspective view of the rotating mass component of the apparatus of the invention showing an eddy current braking arrangement.

Referring to FIG. 7, a preferred embodiment for both developing the noted hydrodynamic drag term as well as for applying a brake form of control to the flywheel 200 is revealed generally at 300. The rotational mass or flywheel modulator 300 includes a d.c. coil 302 mounted upon a steel core intermediate and coupled with oppositely disposed pole pieces 304 and 306. Generally, highly permeable ferrous materials are utilized for the core, pole pieces and the like of this assembly. The pole pieces 304 and 306, in turn, are coupled to rectangular pole shoes shown, respectively, at 308 and 310. With the arrangement shown, as the flywheel 200 is rotated, a voltage is generated across the magnetic field developed from assemblage 300 which invokes eddy current activity, in turn, developing an $I^2R$ power loss. By providing computer derived control over the modulator 300, improved forms of kinetic simulation can be developed.

Figure 8:
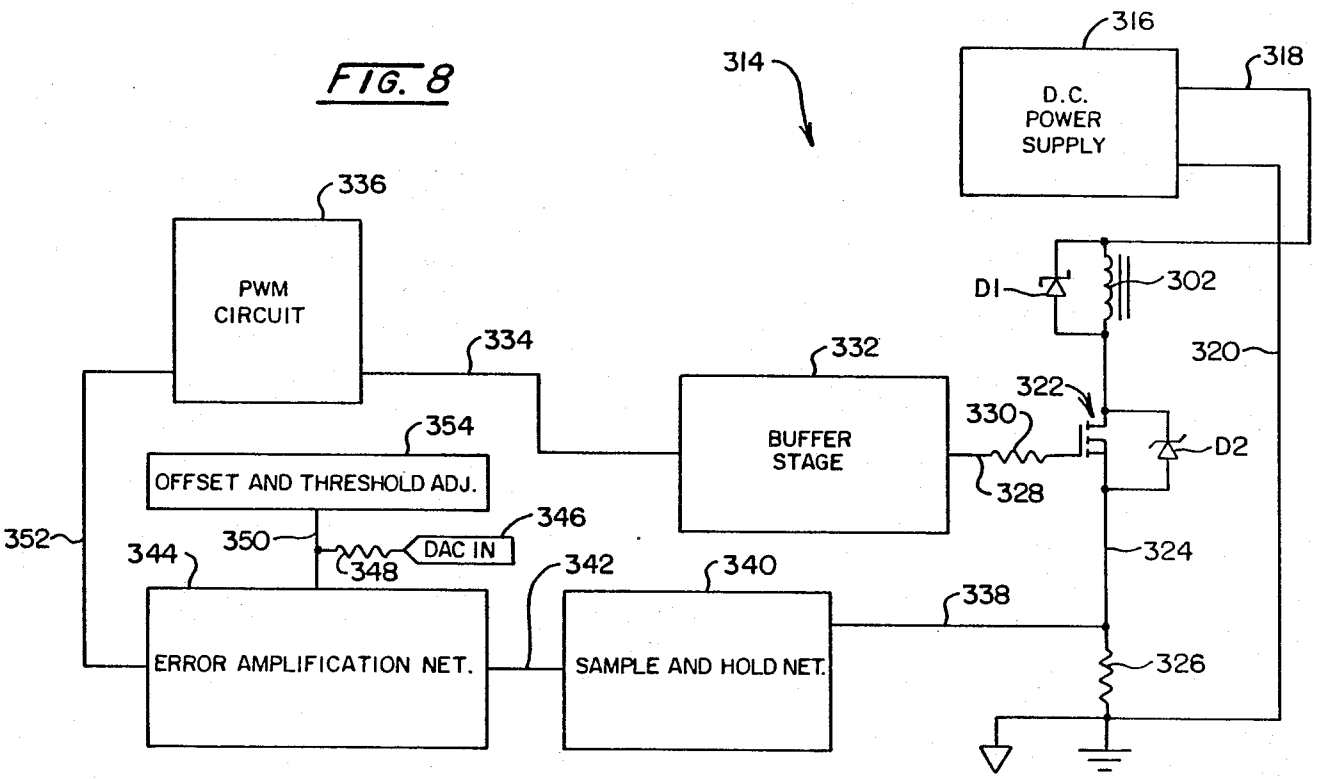
FIG. 8 is a block diagrammatic representation of a pulse width modulation amplifier circuit employed with the braking arrangement of FIG. 7.

Preferably, the control into flywheel modulator assemblage 300 is provided using a pulse width modulation (PWM) technique. Looking to FIG. 8, a computer controlled circuit for carrying out this function is revealed. In the figure, a d.c. power supply is provided as represented at block 316 which, in turn, is powered from a conventional a.c. input. The resultant d.c. output, for example 30 v at 5 amperes, is provided at lines 318 and 320, the latter being coupled to ground. Line 318 extends to one side of coil 302 and thence to a switching MOSFET power transistor 322. The opposite side of transistor 322 is coupled by line 324 to ground and includes a current shunt resistor 326 serving to develop a voltage signal proportional to current flow. A fast response diode D1 is positioned about coil 302 providing a freewheeling function at turn-off of transistor 322. Similarly, a Zener diode D2 is positioned about transistor 322 to limit the voltage thereacross. The gate of transistor 322 is coupled by line 328 incorporating gate resistor 330 to the output of a buffer stage represented at block 332. Stage 332, in turn, receives the control output at line 334 of a pulse width modulator circuit represented at block 336. Circuit 336 may, for example, be provided as a type UC1637 switched mode controller for d.c. motor drive marketed by Unitrode Integrated Circuits of Merrimack, N.H.

The earlier-noted voltage signal proportional to current is monitored via line 338 which, in turn, is coupled to a sample and hold network represented at block 340. Network 340 functions to sample the voltage developed at resistor 326 during current flow representing an on condition at transistor 322. The thus-sampled signal, in turn, is monitored as represented by line 342 by an error amplification network represented at block 344. Network 344 includes an initial amplification stage, the output of which is summed with an input or control command signal which is computer generated. In this regard, a digital-to-analog converter (DAC) is provided by the control feature described later herein as represented at 346 which receives an input from a control computer, such input being converted to an analog signal and presented along lines 348 and 350 to a summing point within network 344. The resultant summed signal then is directed to a next gain stage and the summed control signal is presented along line 352 to the control input of PWM circuit 336. Offset and threshold adjustment may be provided, for example by a potentiometer or the like as represented at block 354 seen coupled by line 350 to network 344.

Figure 9:
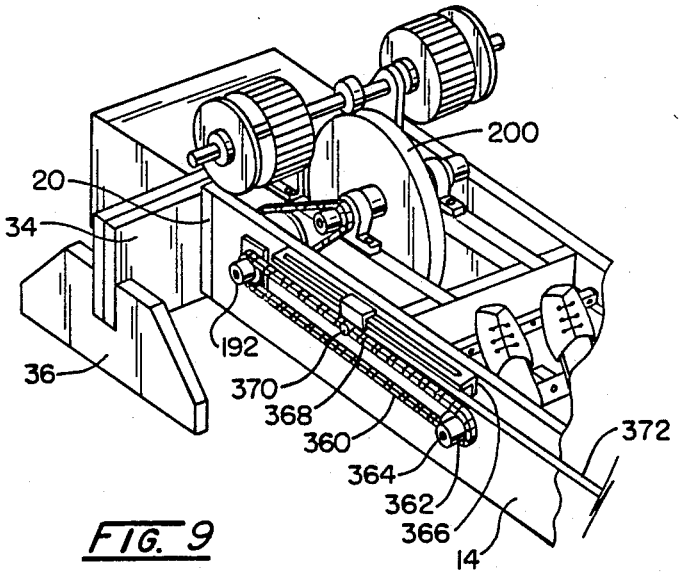
FIG. 9 is a partial perspective view of an alternate embodiment for a drive input to the rotating mass of the apparatus of the invention.

Referring to FIG. 9, an alternate and preferred arrangement for transferring force from the oars 136 and 136' into the input or drive sprockets as at 192 and 222 (FIG. 5) is revealed. In the figure, the drive chain as at 360 is shortened and provided in loop form such that it rides about freely-rotatable sprocket or pulley 362 which is mounted to a side member as at 14, for example upon shaft 364. Mounted as shown upon side member 14 additionally is a linear guideway 366 upon which a slide block 368 is slideably positioned. This slide block is coupled at 370 to the upwardly disposed loop component of the chain 360. Slide block 368 additionally is connected to a steel rod which, in turn, is connected with a force transfer arm as at 184 and 184'(FIG. 1) which are driven from the simulated oars 136 and 136'.

Figure 10:
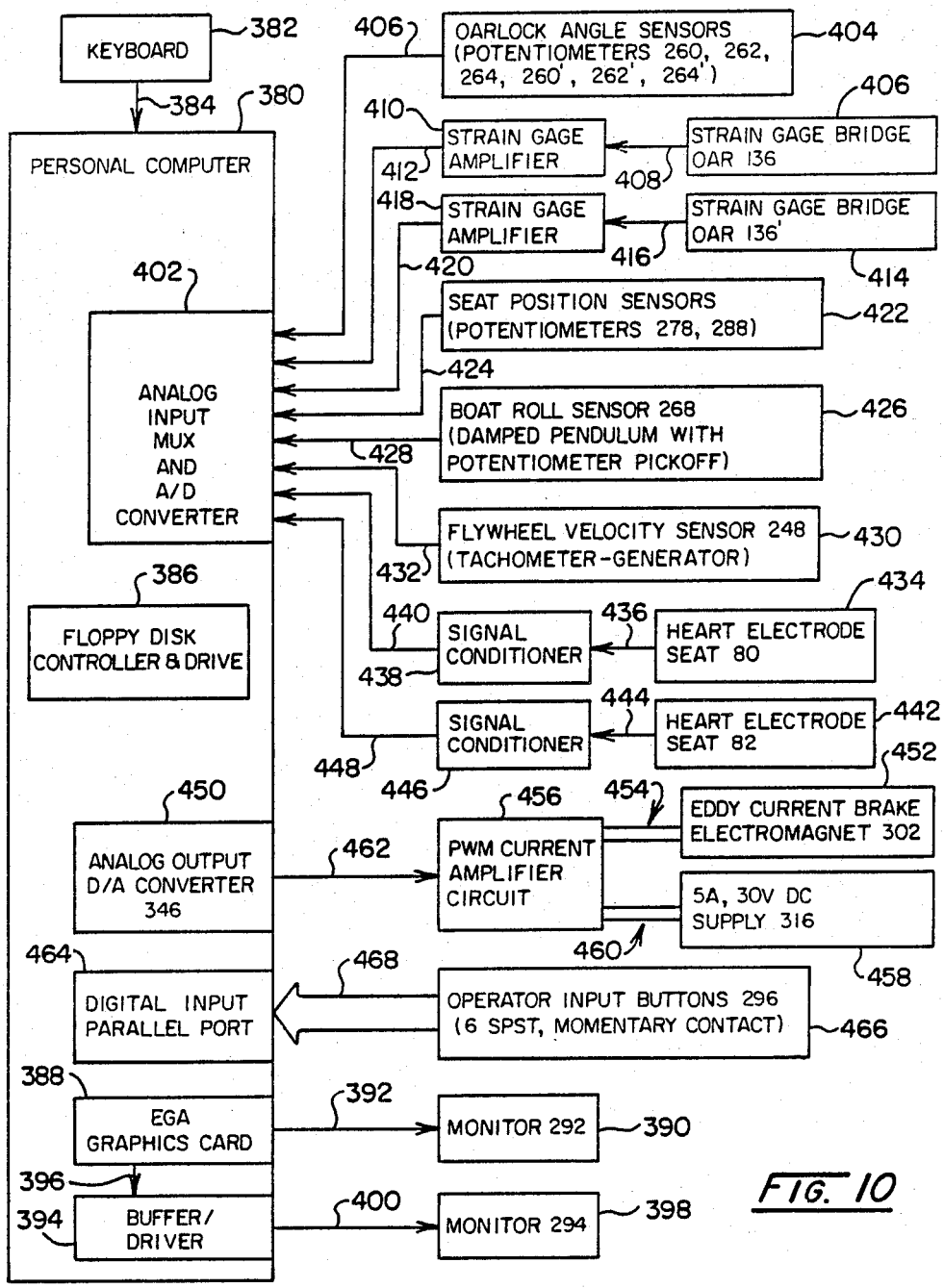
FIG. 10 is a block diagram of the control circuit employed with the apparatus of FIG. 1.

Referring to FIG. 10, a block diagrammatic representation of the control components of the assembly 10 is revealed. In general, the control is computer driven, preferably from a personal computer (PC) type having the capabilities of the PC/AT devices marketed by International Business Machines Corporation. A variety of circuit or module components are available to such computer systems which are sometimes referred to as cards. This computer function is represented at block 380 and is seen associated with a keyboard as represented at block 382 and line 384. The computer, in typical fashion will include a floppy disk with associated control or drive as represented by sub-block 386 and will additionally incorporate an enhanced graphics adapter (EGA) or graphics card as represented at sub-block 388. Block 388 is seen functioning to drive the visual readout or monitor 292 as represented at block 390 and 392. Because two such readouts are provided, a buffer driver is incorporated with the graphics card 388 as represented at blocks 394 and 396. Thus, an identical readout is provided for the monitor 294 as represented at block 398 and line 400.

Transducer inputs to the computer 380 are asserted at an analog input as represented at sub-block 402. Additionally included within this analog input module is a multiplexing function as well as an analog-to-digital conversion function. Those potentiometers which describe various degrees of freedom at the oarlocks of the simulator are represented at block 404 as providing analog signal inputs through certain of the wiring of a harness assembly as represented at line 406. In similar fashion, the two strain gauges as at 260 mounted upon load arm or tube 162 are configured in a conventional strain gauge bridge fashion as represented at block 406. The output of this bridge is directed as represented at line 408 to a strain gauge amplifier stage represented at 410 and the thus-amplified output is submitted to the analog input 402 of computer 380, as represented at line 412. As discussed earlier herein, it is preferred that the strain gauge bridge and the amplification stage 410 be packaged within the load tubes as at 162 themselves. In similar fashion, the strain gauges of the opposite oar 136' are mounted within a bridge as represented at block 414. The output signal of this bridge then is directed, as represented at line 416, to a strain gauge amplifier represented at block 418. This thus-amplified signal then is directed to the analog input 402 of computer 380 as represented at line 420.

The seat position sensors as represented at potentiometers 278 and 288 (FIG. 3) are represented at block 422. These outputs are directed to the analog input 402 as represented at line 424. The damped pendulum form for sensing housing roll about its roll axis as described at 268 in conjunction with FIGS. 2 and 3 is represented at block 426 providing an output to the analog input 402 as represented at line 428. The flywheel velocity sensor or tachometer 248 is represented at block 430 providing a signal input to the analog input 402 as represented at line 432.

Because of the current interest of coaches in the aerobics associated with training oarsmen, it is desirable that the heart rate of the oarsman under training be monitored. This is carried out in conventional fashion utilizing body mounted electrodes and highly sensitive voltage responsive circuits. Accordingly, a heart electrode for the oarsman at seat 80 is represented at block 434 providing an output as represented at line 436 to a signal conditioner represented at block 438. The resultant conditioned analog signal is directed via line 440 to the analog input 402. In similar fashion, heart electrodes are applied to the oarsman in training at seat 82 and the output of this monitoring is directed as represented at line 444 to a signal conditioner represented at block 446, whereupon the conditioned signal is directed to the analog input 402 as represented at line 448.

Computer 380 additionally includes an analog output module as represented at sub-block 450. This output, in particular, functions to provide control over the flywheel 200 from a braking standpoint utilizing the eddy current braking device 300 as described in conjunction with FIG. 7. The electromagnet coil 302 is represented at block 452 being selectively energized from line pair 454 by the pulse width modulation current amplifier circuit 314 as represented at block 456. The d.c. power component 316 is herein represented at block 458 as providing a d.c. power supply via line pair 460 to the circuit represented at block 456, and the digital-to-analog converter 346 is shown contained within module 450 functioning to provide an analog signal to circuit 314 as represented at line 462.

Additionally incorporated with the computer 380 is a digital input provided as a parallel port module represented at sub-block 464. This input receives the corresponding digital input from the array of six switches at the visual readouts of monitors 292 and 294. These switch arrays are represented at 466 providing a parallel input to the module 464 as represented by arrow 468.

Figure 11:
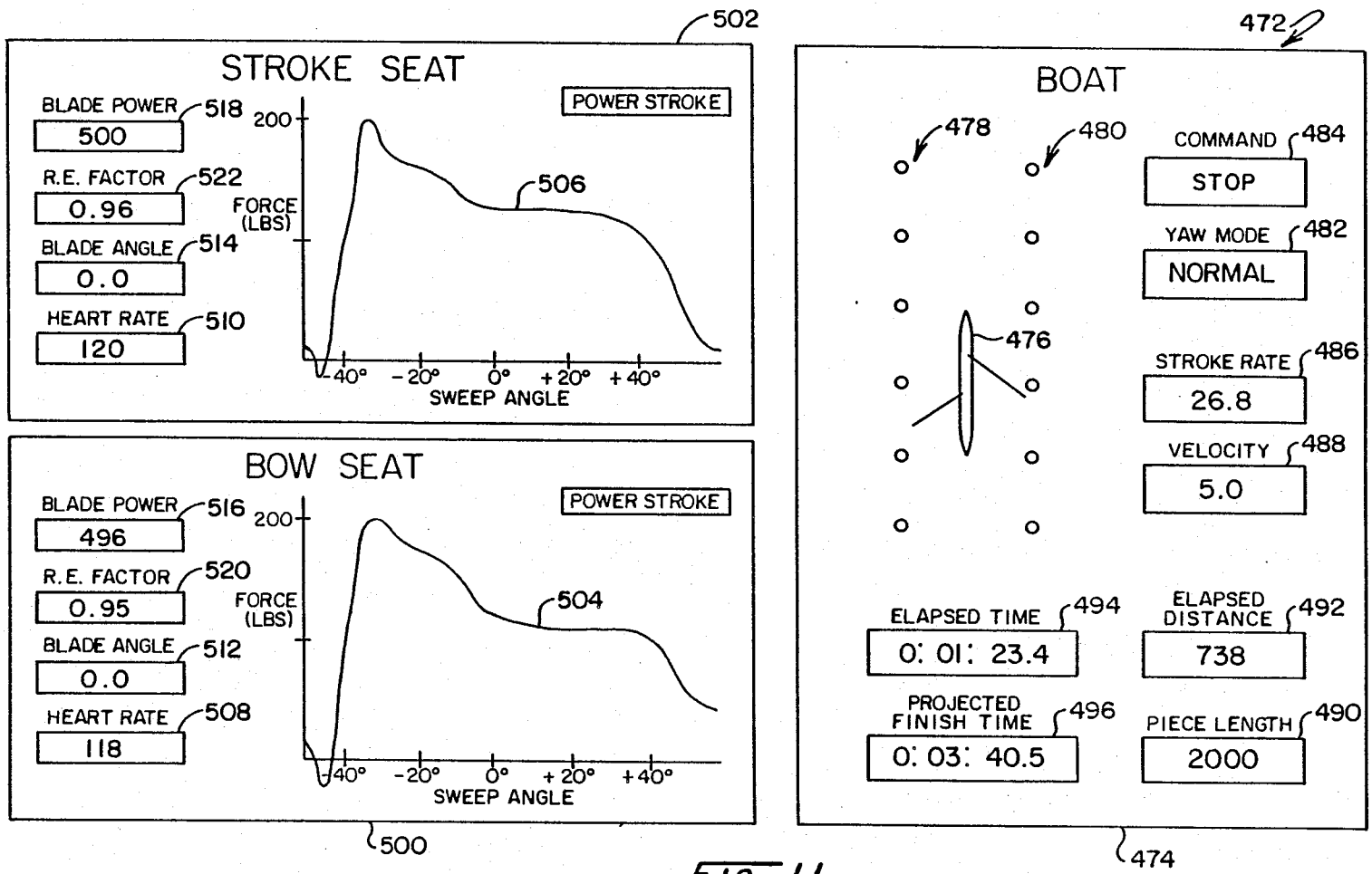
FIG. 11 is a pictorial representation of a readout which may be generated by the apparatus of FIG. 1.

Referring to FIG. 11, a sample readout display developed at monitors 292 and 294 is depicted and represented in general at 472. The display 472 includes a right portion within block outline 474 which shows pair parameters including a simulated pair boat 476 which is positioned within simulated lane defining parallel lines of buoys 478 and 480. These images of lines of buoys are made to appear to move with respect to boat image 476 in relation to the simulated and computed velocity of the "boat". Additionally, where uneven stroking of the simulated oars 136 and 136' develops a condition wherein the boat simulated heading will change, the image 476 will move accordingly. The oarsman under training may elect this latter "yaw" mode as being normal or it may be essentially eliminated where novice oarsmen are in training. In the latter regard, conditions may be encountered wherein the novice oarsman will develop simulation signals which would move the boat image 476 out of the display. Selection of yaw mode is displayed within a block as represented as an alternate display at 482 and is elected from appropriate actuations at the array of switches as at 296. The commencement of a race is selected by the oarsman in training or a coach by pressing select ones of the switches of the array 296 and the resultant sequence of switch actuations will provide a command display at a block on the screen represented at 484. These commands will include a stop command as well as a race or piece start. For the latter function, the start will sequentially display the words "ready", "set", "go". Upon the display of the latter command, the timing system will commence and simulation and monitoring will begin. Stroke rate is displayed at block 474 as represented at block 486. This is the rate of completing an entire stroke from catch to recovery and return which, under pair conditions, is developed from the activity of the stroke seat 82. For convenience, the stroke is timed from a zero degree of sweep angle representing an oar position perpendicular to the longitudinal or roll axis of the simulated boat. Where only bow seat 80 is being utilized, stroke rate may be monitored from that position by manipulation of the switch arrays as at 296. The computed velocity of the simulated boat is displayed within a block as represented at 488. Piece length or length of a given simulated race or training distance is selected by switch actuation at array 296 and is diplayed at block 490, while the elapsed distance for that given piece length is displayed at a block represented at 492. The elapsed time from a start event or go display at block 484 is displayed at a block shown at 494 and the corresponding projected finish time as is continuously updated is displayed at a block represented at 496.

The performance of the individual oarsman at seats 80 and 82 is displayed on the left side of the displays 472 within respective rectangular outlines 500 and 502. Each of these outlines 500 and 502 is seen to contain a graphical display, that being depicted representing the relationship of force developed by the oarsman through the simulated oar versus the sweep angle of the oar. The particular relationship between these two parameters will vary with the ability of the oarsman. However, the optimum relationship or curve represents a technique which is uniquely determined by each coach. Sweep angle is measured in terms of a negative arc commencing with the catch position and reaches a zero degree position at a location wherein the simulated oar is perpendicular to the longitudinal axis of the simulated boat hull. A selection of maximum force in this stroke may be made, as illustrated, at or just following the commencement of a catch or it may vary to achieve optimum boat performance. By manipulating the noted switches at array 296, other graphical displays may be selected. In this regard, seat position versus sweep angle, or oar elevation versus sweep angle may be displayed. Additionally, a value for rower or oarsman's effective stroke power versus stroke number may be elected. Each oarsman is apprised of monitored heart rate as represented at display blocks 508 and 510. Additionally, the simulated roll angle of the oars 136 and 136' as developed from potentiometers 266 and 266' is treated to develop a blade state display as represented at display blocks 512 and 514. In general, if a blade angle representing a crab condition is detected, the display blocks 512 and 514 will be illuminated in a red color. Similarly, if a washout blade angle is detected wherein the blade is angled at catch so as to be propelled from the surface of the water, then the blocks 512 and 514 are illuminated in a yellow color. Conditions may be read out at blocks 512 and 514 such as "deep", "check", "miss" and "wash". The effective stroke power asserted by each of the oarsmen is computed and displayed under the trademark "Blade Power" within display blocks 516 and 518, and a corresponding rowing efficiency factor representing a relationship of the effective work performed by the simulated oar and the work carried out by the oarsman is displayed at display blocks 520 and 522.

Figure 12:
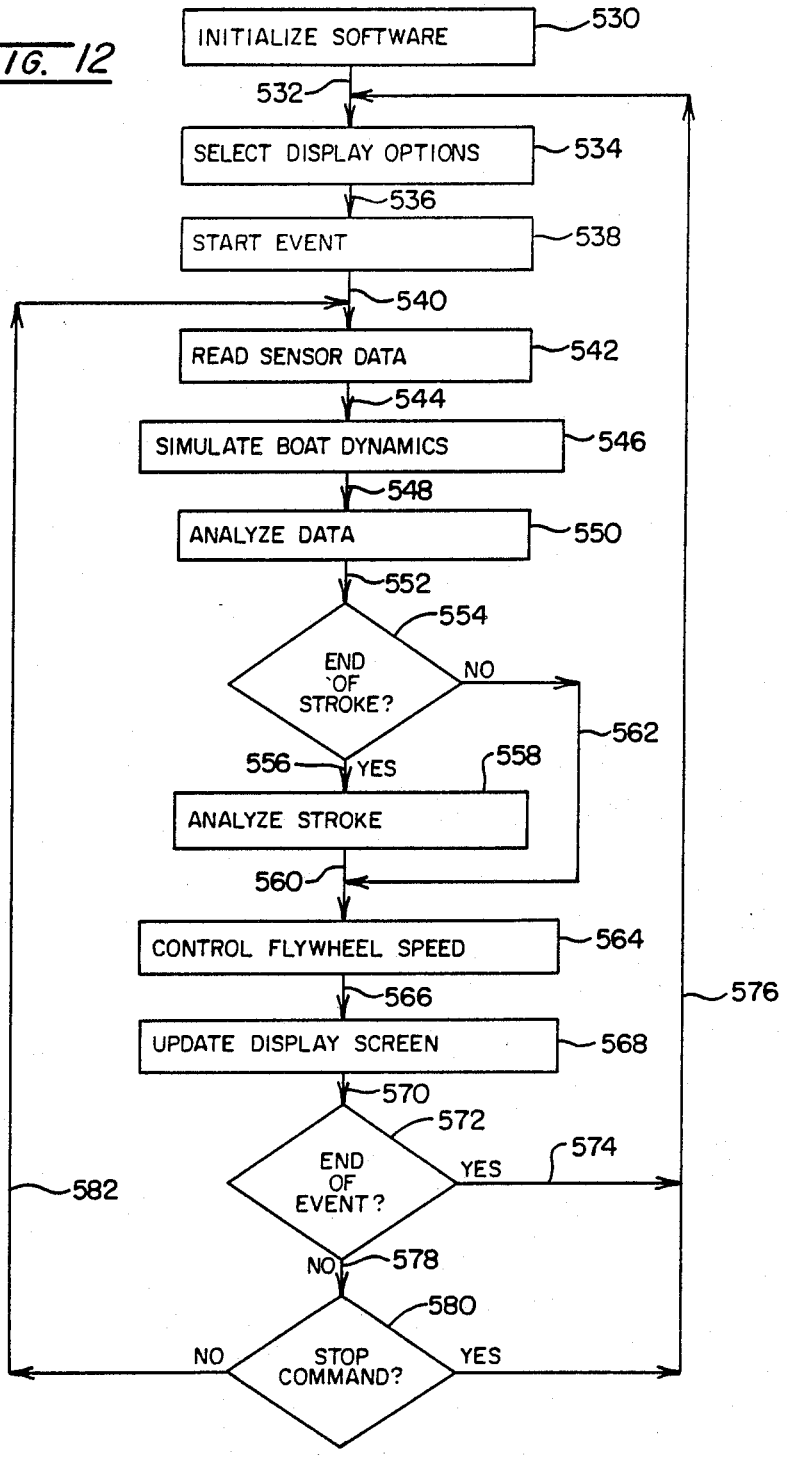
FIG. 12 is a flow chart representation of a control program employed with the circuit of FIG. 10.

Referring to FIG. 12, a flow chart representing the general software program of the control function is revealed. This program commences its initialization procedure as represented at block 530. Then, as represented by a line 532 and block 534, the program awaits the operator selection of display options by the actuation of the noted switches of the array 296. In general, one such switch will cause the highlighting of the various fields seen in the display. Upon such field or box being highlighted, a second button may be pushed that toggles through a variety of options for selecting the type readout or command desired. The program then continues as represented at line 536 and block 538 to commence the start of an event and this occurs with the display of a go signal at the command block 484 as described in conjunction with FIG. 11.

The program continues as represented at line 540 and block 542 to read all of the sensor data or data from the various potentiometers, strain gauges, and heart monitors for submission to temporary memory. The program then continues as represented at line 544 and block 546 to carry out a simulation of boat dynamics. This is a procedure involving straightforward Newtonian physics wherein the forces and positional geometries recorded from the simulated oars are read. Then the program models the mass of the boat and determines what the acceleration of the boat would be, given those parameters. Simulated velocity and boat position then are determined by staged integration. The program then continues as represented at line 548 and block 550 to carry out an analysis of data. This routine looks to the simulated performance of the boat and the parameters thus developed are employed to determine the stroke rate, rower efficiency factors and the like. Certain of the outputs are developed based upon a given stroke which arbitrarily is determined as the transition from a zero angle stroke position of a last stroke to a next succeeding stroke positioning at that same zero angle position. The routine then continues as represented at line 552 and decision block 554 to determine whether an end of the stroke has occurred. In the event that it has, then as represented at line 556 and block 558 an analysis of the parameters associated with a full stroke is carried out. The program then continues as represented at line 560. Where the determination at block 554 is in the negative, the program loops to line 560 as represented by loop line 562 and carries out a control of the flywheel 200 speed utilizing assemblage 300 as represented at block 564. In effect, where the stroke is defective or misses the water surface, then corresponding braking is applied to the flywheel in addition to an assertion of the hydrodynamic drag term. With this control of mass term and hydrodynamic drag term, the program continues as represented at line 566 and block 568 to update the display screens at monitors 292 and 294 and, as represented at line 570 and decision block 572, a query is made as to whether an event has ended. This is developed as an accumulation of position information, i.e. elapsed distance versus piece length. In the event of an affirmative determination at block 572, then as represented at lines 574 and 576, the program returns to line 532 to await the selection by the operator of display options. Where a determination at block 572 is made that the event has not ended, then as represented at line 578 and decision block 580, a query is made as to whether a stop command has been entered from the switch array as described at 296. Where a stop command has been received, then as represented at line 576 the program loops to line 532 to await a selection of display options. Where no stop command has been received, then the program loops as represented at line 582 to line 540, whereupon the program continues from block 542 collecting sensor data.

Determination of the rower efficiency (R.E.) on a per rower basis requires a dynamic simulation of the boat, for example as to position, speed and the like as a preliminary consideration. To develop boat dynamic simulation the following procedures are carried out by the software as discussed in general in connection with blocks 542 and 546 above. Where appropriate, analog input lines described in conjunction with FIG. 10 are identified.

BOAT SIMULATION

1. Read the boat roll angle from the roll sensor. (428)
2. Read oar sweep, elevation, and roll angles from the position sensors. (406)
3. Read oar sweep torque from the force sensor. (412,420)
4. Compute the position of the oar blade centroid. It is assumed that the center of pressure is at this point, and that the resultant force on the blade is normal to the blade surface.
5. Determine if the blade is above or below water surface.
6. If the blade is in the water, then compute the blade force vector based on the measured oar torque. Where the blade is not in the water, compute the blade force vector based on blade velocity and aerodynamic drag. These blade forces are in "boat" coordinates.
7. Repeat steps 1 through 6 for the other oar.
8. Calculate the resultant force and torque on the boat due to the oar forces and hydrodynamic forces (which are functions of boat velocity) on the boat hull.

9. Calculate the resulting acceleration of the boat (F=MA)
10. Integrate to obtain boat velocity and position.

Steps 1 and 2 above provide for obtaining the roll angle of the boat as well as the orientation of the simulated oar as at 136. This information is derived and applied as described in conjunction with FIG. 10 from lines 428 and 406. As represented at Step 3, then the torque derived from strain gauges is read as represented at lines 412 and 420. The information represented by steps 2 and 3 is employed to derive the graphs as described at 504 and 506 in FIG. 11.

Step 4 carries out computation of the oar blade centroid. In this regard, the simulated oars at 136 and 136' are foreshortened and thus, it is necessary to compute the location at the simulated blade of this centroid. The location of the oar blade within or without the water is determined from the boat roll angle of step 1 and oar elevation angle. Variation from proper oar roll angle also will affect the computation for this torque at the blade centroid or center of pressure. Step 5 determines if the simulated oar blade is above or below the water surface. For example a washout may be determined or the oar may be in its return stroke maneuver. Following this oar and water relationship determination, as set forth in step 6, a computation of the blade force vector based on measured torque is carried out. This computation is varied with respect to the roll orientation of the oar. Where the oarsman is recovering an oar, and the blade is not in the water, then proper procedure calls for feathering the blade which is represented as an adjustment of oar angle. Accordingly, for such condition, a force vector based upon the velocity of the simulated oar blade and aerodynamic drag thereon is carried out. Thus, if the roll angle of the blade is improper, a corresponding drag adjustment is inserted.

In carrying out simulation, a multiple of coordinate systems are assigned with respect to different aspects of the simulation apparatus. One such coordinate system is located at the simulated blade of the simulated oars. Still another of these coordinate systems is fixed with respect to the simulated boat hull itself in that it does not move with respect to the boat. Finally, an inertial coordinate system is considered which is referenced with respect to earth. Accordingly, as noted at step 6, the blade forces are developed with respect to the boat coordinate system. Following the above, as set forth in step 7, steps 1–6 are repeated for the oppositely disposed oar.

The routine at hand is one which necessarily represents a six dimensional problem inasmuch as moments will be generated in the course of a sweeping motion of oars and thus, in addition to linear forces aligned with the longitudinal axis of the boat, torque values will be developed. For a detailed discourse concerning such problems, reference is made to the text "Robot Manipulators: Mathematics, Programming and Control" by Richard P. Paul, MIT Press, 1981, Cambridge, Mass., which is incorporated herein by reference. However, inasmuch as boats will tend to resist side and turning vectors, a corresponding accommodation is required in the modeling procedure for asserting a directional stability term. In general, a larger stability term is evolved at the aft simulated component of the boat hull as opposed to the bow region. Hydrodynamic drag, of course, is applied principally in terms of vectors parallel with the longitudinal axis of the boat, however, it remains a six-dimensional parameter. Following the determinations as discussed above in connection with step 8, as set forth in step 9, resulting acceleration is calculated and this calculation is derived from the classic formula F=MA. With the development of an acceleration value, as set forth in step 10, that value is integrated first to obtain a velocity value and next to obtain position. The above procedure of steps 1–10 is carried out at discrete time intervals of length dt which may be selected, for example, as 20 milliseconds.

During each computational interval, after the above simulation routine has updated the simulated state of the boat, an analysis is carried out to determine oarsman specific information, for example, the rower effectiveness factor (R.E. factor). The following sequence of steps describes this procedure. Where a quantity is prefixed with the term "Delta", a reference is intended to the change in that quantity over the discrete time interval, dt.

ROWER EVALUATION

1. Calculate rower output work (and instantaneous power).
   DeltaRowerWork:=ABS (DeltaSweepAngle * OarSweepTorque);
   RowerPower:=DeltaRowerWork/dt;
   StrokeRowerWork:=StrokeRowerWork+DeltaRowerWork.
2. Calculate the effective work done by the rower.
   DeltaEffectiveWork:=DeltaBoatPosition$_{13}$Boat.X * StrokeOarForce$_{13}$Boat.X;
   EffectivePower:=DeltaEffectiveWork/dt;
   StrokeEffectiveWork:=StrokeEffectiveWork+DeltaEffectiveWork;
3. Repeat steps 1 and 2 for the other rower.
4. Determine if a new stroke has begun.
5. If a new stroke has begun, then perform steps 6 through 9, else exit the routine.
6. Calculate the stroke period.
   StrokePeriod:=CurrentTime−PreviousStrokeStartTime;
   PreviousStrokeStartTime:=CurrentTime;
7. Calculate average stroke power and efficiency.
   RowerStrokePower:=StrokeRowerWork/StrokePeriod;
   EffectiveStrokePower:=StrokeEffectiveWork/StrokePeriod;
   REfactor:=StrokeEffectiveWork/StrokeRowerWork.
   StrokeRowerWork:=0.0;
   StrokeEffectiveWork:=0.0;
8. Repeat steps 6 and 7 for the other power.
9. Compute the stroke rate from the stroke period.
   StrokeRate:=60.0/StrokePeriod; (strokes per minute)

Step 1 above serves to calculate how much work the oarsman in training is putting into the oar handle. The amount of work the oarsman did in one sampling increment is developed as the absolute value of the product of incremental sweep angle which is multiplied by oar sweep torque, a computation equivalent to force being multiplied by distance. Thus, a value for DeltaRowerWork is computed. The rower power then may be computed as the earlier computed DeltaRowerWork divided by the sampling increment, dt. This is essentially instantaneous power which represents work divided by time. The StrokeRowerWork represents the amount of work done over the course of a stroke. Thus, the sampling increments are cumulated (integrated) or added to provide an integrated valuation at the termination of a given stroke. Accordingly, this value is initialized to zero at the start of any given stroke. An absolute value of DeltaRowerWork is derived inasmuch as power is not regenerated in oarsman muscles and if the oarsman in training is doing a negative form of work that work is still accommodated for.

Following the above, the EffectiveWork done by the rower is calculated. The EffectiveWork is calculated with respect to those forces functioning to accelerate the boat in a forward direction along its longitudinal axis, i.e. in the X axis. In the step described, the underscore represents the coordinates involved, i.e. boat coordinates in an X direction. Thus, the change in position of the simulated boat along the noted longitudinal or X direction is multiplied by the stroke oar force in that same direction. Note that no absolute value is taken here inasmuch as, if activity is taken in a negative direction, the boat indeed will slow down. The above position component and others also may be derived as the product of instantaneous velocity times dt. Effective power then is represented as the DeltaEffectiveWork computed divided by the sampling time interval, dt. StrokeEffectiveWork represents the work carried out over an entire stroke and it is the accumulated StrokeEffectiveWork plus the latest computed DeltaEffectiveWork.

Step 3 repeats steps 1 and 2 for the next rower position and step 4 determines if a new stroke has begun as determined from the zero degree sweep position. As noted in step 5, with the presence of a new stroke, then steps 6–9 are carried out. Otherwise the routine is exited. These next steps 6–9 are represented in FIG. 12 at the analyze stroke procedure discussed in connection with block 558. In step 6, the StrokePeriod is calculated as the current time less the previous stroke start time. The same routine then provides that the previous stroke start time then is made equivalent to the current time. In step 7, the average stroke power and efficiency are calculated. In this regard, RowerStrokePower is made equivalent the earlier-described StrokeRowerWork, i.e. the accumulated value from step 2, divided by the StrokePeriod, as calculated in step 6. In effect, this represents work divided by time. This value RowerStrokePower is not described as being displayed, however it may be at the option of the user. The EffectiveStrokePower then is computed as the earlier computed StrokeEffectiveWork divided by the StrokePeriod. This is the average power that actually would cause the simulated boat to go forward over an entire stroke. It is displayed to the oarsman and coach as described at display blocks 516 and 518. The rower efficiency factor (R.E. factor) displayed at display blocks 520 and 522 represents the ratio of the RowerEffectiveWork over the RowerOutputWork for a given stroke. Accordingly, the better the technique exhibited by the oarsman in training the higher the value of REfactor, i.e. the less waste of work on the part of the oarsman. This waste of course represents ineffective or poor manipulation of the oar in water or air media. The remainder of step 7 shows that the StrokeRowerWork and StrokeEffectiveWork are reset to zero inasmuch as these values are accumulated over a period of a given stroke.

In step 8, steps 6 and 7 are repeated for the second oarsman and in step 9, the StrokeRate is computed from the StrokePeriod to provide a strokes per minute output.

Since certain changes may be made in the above-described apparatus and method without departing from the scope of the invention herein involved, it is intended that all matter contained in the description thereof or shown in the accompanying drawings shall be interpreted as illustrative and not in a limiting sense.

I claim:

1. Apparatus for training oarsmen to row a racing shell operationally exhibiting give mass and hydrodynamic drag terms, comprising:

a racing shell simulative housing having a longitudinal roll axis and a given boat plane;

an oarsman seat mounted upon said housing;

an oarlock supported from said housing;

a simulated oar extending along an oar axis and pivotally mounted with a oarlock;

a rotatable mass mounted for rotation with respect to said housing for simulating said mass term;

a drive linkage coupled in driven relationship with said oar and in driving relationship with a rotatable mass;

drag means for imposing a select drag upon said rotatable mass simulative of said hydrodynamic drag term;

a sweep angle transducer responsive to the sweep angle of said oar for providing a sweep angle output;

a force transducer responsive to the forces transmitted by an oarsman through said oar while positioned upon said seat for providing a force output;

control means responsive to said sweep angle output and said force output for deriving a power stroke output representing values of said force exerted from said oar with respect to sweep angle; and readout means responsive to said power stroke output for providing a perceptible readout representative thereof.

2. The apparatus of claim 1 including:

rotation transducer means responsive to the angular orientation of said oar about said oar axis for providing a rotation output;

said control means is responsive to said rotation output for deriving a rotation output signal.

3. The apparatus of claim 1 including:

oar elevation transducer means responsive to the angle of said oar axis with respect to said boat plane for deriving an elevation output; and said control means is responsive to said elevation output for deriving an elevation output signal.

4. The apparatus of claim 1 including a blade flotation simulator fixed to said oar and resiliently deformable to simulate the floation of an oar blade in water.

5. The apparatus of claim 1 in which:

said oar extends a predetermined distance beyond said oarlock over a contact surface; and including a blade flotation simulator fixed to said oar at a location outwardly from said oarlock and resiliently deformably contactable with said contact surface in simulation of the flotation of an oar blade in water.

6. The apparatus of claim 1 including:

a support structure pivotally supporting said housing for rotatable movement about said longitudinal roll axis simulation of the flotation of said racing shell upon water;

a roll transducer responsive to said housing rotatable movement to derive a roll output; and said control means is responsive to said roll output for deriving a roll output signal.

7. The apparatus of claim 6 in which said roll transducer is a potentiometer configured as a damped inclinometer coupled to the vicinity of said housing along said longitudinal roll axis.

8. The apparatus of claim 1 in which:

said oarsman seat is mounted for movement along said housing longitudinal roll axis between end positions:

wherein said apparatus further excluding including seat transducer means responsive to said seat movement for deriving a seat position output representing the position thereof along said longitudinal roll axis; and said control means is responsive to said seat position output for deriving a seat output signal.

9. The apparatus of claim 1 in which said drag means comprises a hydrodynamic drag simulator mounted in driven relationship with said rotatable means and simulating said hydrodynamic drag term.

10. The apparatus of claim 1 in which:

said rotatable mass is a flywheel; and said drag means comprises a fan having a shaft positioned in driven relationship with said flywheel and having an input component adjustable to the extent of air input thereto.

11. The apparatus of claim 1 including:

a support structure pivotally supporting said housing for rotatable movement about said longitudinal axis in simulation of the flotation of said racing shell upon water; and a blade flotation simulator fixed to said oar and resiliently deformable to simulate the flotation of an oar blade in water.

12. Apparatus for training oarsmen to row a racing shell operationally exhibiting given mass and hydrodynamic drag terms, comprising:

a racing shell simulative housing having a longitudinal axis and a given boat plane;

first and second spaced oarsman's seats mounted upon said housing;

first and second oarlocks supported from said housing adjacent respective said first and second seats;

first and second simulated oars each extending along an oar axis and pivitally mounted with respective said first and second oarlocks;

a rotatable mass mounted for rotation with respect to said housing for simulating a mass term;

a first drive linkage connected in driven relationship with said first oar and in driving relationship with said rotatable mass;

a second drive linkage connected in driven relationship with said second oar and in driving relationship with said rotatable mass; and drag means for imposing a select drag upon said rotatable mass simulative of a viscous drag term.

13. The apparatus of claim 12 including a support structure pivotally supporting said housing for rotatable movement about said longitudinal axis in simulation of the flotation of said racing shell upon water.

14. The apparatus of claim 13 in which:

each said first and second oars extend a predetermined distance beyond respective said first and second oarlocks over a contact surface; and wherein said apparatus further including first and second blade flotation simulators fixed respectively to said first and second oars at a location outwardly of respective said first and second oarlocks, each being resiliently deformably contactable with said contact surface in simulation of the flotation of an oar blade in water.

15. The apparatus of claim 12 in which:

said housing includes first and second outriggers extending laterally outwardly to an oarlock support from the vicinity of respective said first and second oarsmans seats in generally parallel relationship with said boat plane; and said first and second oarlocks are mounted upon the said oarlock support of respective said first and second outriggers.

16. The apparatus of claim 12 including:

first and second sweep angle transducers responsive to the sweep angle of respective said first and second oars for respectively providing first and second sweep angle outputs;

first and second force transducers responsive to the force transmitted by said oarsmen through said first and second oars when positioned respectively upon said first and second for providing respective first and second force outputs;

control means responsive to said first and second sweep angle outputs and said first and second force outputs for deriving respective first and second power stroke outputs representing the relationship of force with respect to sweep angle; and readout means responsive to said first and second power stroke outputs for providing perceptible readouts representative thereof.

17. The method for evaluating the performance capability of an oarsman for rowing a racing shell exhibiting given mass and hydrodynamic drag terms, comprising the steps of:

providing a racing shell simulative housing having a longitudinal axis and a given boat plane;

providing an oarlock supported from said housing;

providing a simulated oar extending along an oar axis and pivotally mounted with said oarlock;

providing an oarsman seat mounted for rotation with respect to said housing for simulating a mass term;

providing a drive linkage coupled in driven relationship with said oar and in driving relationship with said rotatable mass;

providing a drag assembly for selectively controlling the rotation of said rotatable mass;

providing a sweep angle transducer responsive to the sweep angle of said oar for providing a sweep angle output;

providing a force transducer responsive to the forces transmitted by an oarsman through said oar into said drive linkage and rotating mass while positioned upon said seat for providing a force output;

causing said oarsman to sit upon said seat and execute an oarstroke with said oar;

providing a computer driven control responsive to said sweep angle output and said force output for generating a power;

a power stroke output representing the values of force exerted during said oarstroke with respect to sweep angle; and displaying said power stroke output to said oarsman in visual graphic form.

18. The method of claim 17 further including the steps of:

providing an elevation transducer responsive to the angle of said oar axis with respect to said boat plane for deriving an elevation output;

configuring said control for response to said elevation output;

generating an oar elevation versus sweep angle output; and displaying said oar elevation versus sweep angle output to said oarsman in visual graphic form.

19. The method of claim 17 further including the steps of:

providing said seat to be movable along said longitudinal axis;

providing a seat transducer responsive to movement of said seat for deriving a seat position output;

configuring said control for response to said seat position output;

generating a seat position versus sweep angle output; and displaying said seat position versus sweep angle output to said oarsman in visual graphic form.

20. The method of claim 17 further including the steps of:

providing an elevation transducer responsive to the angle of said oar axis with respect to said boat plane for deriving an elevation output;

configuring said control for response to said elevation output;

computing the simulated position of the blade centroid of said oar, the blade force vector based upon said force output, boat acceleration, velocity and position;

deriving for each of a sequence of sampling intervals, a Delta Effective Work value as the effective product of Delta Boat Position and Stoke Oar Force representing vectors parallel with said longitudinal axis, and summing said Delta Effective Work values derived over the interval of said oarstroke to generate a Stroke Effective Work value;

deriving the value of Effective Stroke Power by dividing the value of said Stroke Effective Work value by the value of said interval of said oarstroke; and displaying said value of Effective Stroke Power to said oarsman in visual form.

21. The method of claim 20 further including the steps of:

generating an accumulative number of said oarstrokes and deriving an Effective Stroke Power versus Oarstroke Number relationship output; and displaying said Effective Stroke Power versus Oarstroke Number relationship output to said oarsman in visual graphic form.

22. The method of claim 20 further including the steps of:

providing a support structure pivotally supporting said housing for rotatable movement about said longitudinal axis in simulation of the flotation of said racing shell in water;

providing a roll transducer responsive to said housing rotatable movement to provide a roll output; and wherein said step of computing said position of said blade centroid includes an evaluation of said roll output.

23. The method of claim 20 further including the steps of:

providing a rotation transducer responsive to the angular orientation of said oar about said oar axis for providing a rotation output; and wherein said step of computing said position of blade centroid and blade force vector includes an evaluation of said rotation output.

24. The method of claim 17 further including the steps of:

providing an elevation transducer responsive to the angle of said oar axis with respect to said boat plane for deriving an elevation output;

configuring said control for response to said elevation output;

computing the simulated position of the blade centroid of said oar, the blade force vector based upon said force output, boat acceleration, velocity and position;

deriving for each of a sequence of sampling intervals, a Delta Effective Work value as the effective product of Delta Boat Position and Stroke Oar Force representing vectors parallel with said longitudinal axis, and summing said Delta Effective Work values derived over the interval of said oarstroke to generate a Stroke Effective Work value;

deriving for each of a sequence of sampling intervals the value of Delta Rower Work as the absolute value of the effective product of the torque value of said force output and the corresponding movement of sweep angle output, and summing said values of Delta Rower Work derived over the interval of said oarstroke to generate a Stroke Rower Work value; and deriving a Rower Effectiveness factor as the relation of said Stroke Effective Work value to the values of said Stroke Rower Work; and displaying said Rower Effectiveness factor to said oarsman in visual form.

25. The method of claim 24 further including the steps of:

providing a support structure pivotally supporting said housing for rotatable movement about said longitudinal axis in simulation of the flotation of said racing shell in water;

providing a roll transducer responsive to said housing rotatable movement to provide a roll output; and wherein said step of computing said position of said blade centroid includes an evaluation of said roll output.

26. The method of claim 24 further including the steps of:

providing a rotation transducer responsive to the angular orientation of said oar about said oar axis for providing a rotation output; and wherein said step of computing said position of blade centroid and blade force vector includes an evaluation of said rotation output.

27. Apparatus for training oarsmen to row a racing shell operationally exhibiting given mass and hydrodynamic drag terms, comprising:

a racing shell simulative housing having a longitudinal roll axis and a given boat plane;

an oarsman seat mounted upon said housing;

an oarlock supported from said housing;

a simulated oar extending along an axis and pivotally mounted with said oarlock;

a rotatable mass mounted for rotation with respect to said housing for simulating a mass term;

a drive linkage coupled in driven relaitonship with said oar and in driving relationship with said rotatable mass;

drag means for imposing a select drag upon said rotatable mass simulative of a hydrodynamic drag term; and a blade flotation simulator responsive to movement of said oar and simulating the flotation of an oar blade in water.

28. The apparatus of claim 27 in which:

said oar extends a predetermined distance beyond said oarlock over a contact surface; and said blade flotation simulator is fixed to said oar at a location outwardly from said oarlock and resiliently deformable contactable with said contact surface in simulation of the flotation of an oar blade in water.g

* * * * *